US007887346B1

(12) United States Patent
Huang

(10) Patent No.: US 7,887,346 B1
(45) Date of Patent: Feb. 15, 2011

(54) SAFETY SHUTTERS FOR ELECTRICAL RECEPTACLE

(76) Inventor: Huadao Huang, No. 306 Jiaotong Road West, Baixiang Town, Yuequing City, Zhejiang Province (CN) 325603

( * ) Notice: Subject to any disclaimer, the term of this patent is extended or adjusted under 35 U.S.C. 154(b) by 0 days.

(21) Appl. No.: 12/824,587

(22) Filed: Jun. 28, 2010

Related U.S. Application Data

(63) Continuation-in-part of application No. 12/768,394, filed on Apr. 27, 2010.

(30) Foreign Application Priority Data

Sep. 21, 2009 (CN) ..... 2009 2 0222986 U

(51) Int. Cl.
*H01R 13/44* (2006.01)

(52) U.S. Cl. ..... 439/140

(58) Field of Classification Search ..... 439/140, 439/135, 137, 139, 143, 145
See application file for complete search history.

(56) References Cited

U.S. PATENT DOCUMENTS 7,312,963 B1 * 12/2007 Radosavljevic et al. ..... 361/42
7,642,457 B2 * 1/2010 Weeks et al. ..... 174/53

* cited by examiner

*Primary Examiner*—Tho D Ta
*Assistant Examiner*—Travis Chambers
(74) *Attorney, Agent, or Firm*—Mei & Mark LLP

(57) ABSTRACT

A safety shutter device for an electrical receptacle comprises left and fight overlapping sliding blocks. A sliding plate supports a small sliding block. A supporting bracket supports the fight and left sliding blocks and the sliding plate. A first flexible component is between the small sliding block and the sliding plate. The sliding plate and the sliding block are between the right sliding block and the supporting bracket. During a static state, a locking block is mated with a tapered nub to form a self-locking mechanism such that the left, right, and small sliding blocks, the sliding plate, and the supporting bracket are static relative to one another and cover conductive plug bushes under the supporting bracket. When a plug is inserted into a socket of the receptacle, the locking block separates from the tapered nub to unlock the safety shutter device.

20 Claims, 6 Drawing Sheets

SAFETY SHUTTERS FOR ELECTRICAL RECEPTACLE

This application claims the benefit of priority of Chinese patent application 200920222986.1, filed Sep. 21, 2009, the content of which is incorporated herein by reference in its entirety. This application is a continuation-in-part of co-pending U.S. patent application Ser. No. 12/768,394 for Supply Hub Safety Shield, filed Apr. 27, 2010, the content of which is incorporated herein by reference in its entirety.

TECHNICAL FIELD

The present disclosure relates generally to a socket shutter device installed in an electrical receptacle, especially a safety shutter device for installation in an America 5-20R standard electrical receptacle (GFCI) to prevent electrocution deaths and injuries caused by touching the conductive body inside the electrical receptacle.

BACKGROUND

Security is the most important factor for people when choosing household electrical products. Currently, the most widely used electrical receptacle is mainly composed of a housing and two or three groups of conductive metal blades installed in the housing (also known as a hot or live wire output conductive plug bush group, a neutral or zero line output conductive plug bush group, and a ground line conductive plug bush group). There are two-hole and/or three-hole power supply socket openings on the surface of a power supply receptacle shell. And, the above mentioned conductive metal blades are placed in the power supply receptacle, and the blades are connected with the power supply hot line, neutral line, and ground line in the wall through conductive components and conducting wire. Thus, there is power supply output available from the power supply socket openings on the power supply receptacle shell surface.

The live conductive metal blade in the power receptacle is placed under the hollowed power socket opening of the shell surface. Therefore, in real life, some children extend their fingers into the power socket out of curiosity, or they touch the conductive metal blades (that is power output conductive plug bush) under the power socket with their fingers or a metal rod. Once the children touch the conductive metal blades in the receptacle socket, it will lead to the occurrence of electrocution deaths and injuries.

SUMMARY

To avoid the above accidents, a safety shutter device with a self-locking function is proposed for installation in an American 5-20R standard electrical receptacle. When a power supply plug is not inserted in the power supply receptacle, the safety shutter device will cover the electrical receptacle socket openings to cover the I-shaped power supply live line output conductive plug bush and the T-shaped power supply neutral line conductive plug bush. With self-locking features, even if people insert fingers or a metal rod into the power supply sockets out of curiosity, they will not move the safety shutter device, nor touch the electrical live line output conductive plug bush under the electrical socket. The electrical socket is under a closed state, thus, effectively preventing the occurrence of electrocution deaths and injuries caused by people inserting fingers or a metal rod into the power supply socket for curiosity or by accident.

When an electrical plug is inserted into the electrical socket by force, under the action of the electrical plug blades, the safety shutter device is unlocked and active. The I-shaped electrical live line output conductive plug bush and the T-shaped electrical neutral line output conductive plug bush are exposed, thus, allowing insertion of the electrical plug into the 5-20R standard receptacle. When the electrical plug blades are removed, the safety shutter returns to the locked static state.

In one embodiment, a safety shutter device for an electrical receptacle comprises a left sliding block and a right sliding block overlapping the left sliding block. A sliding plate is arranged to support a small sliding block such that the small sliding block slides longitudinally on the sliding plate. A supporting bracket is arranged to slidingly support the right sliding block, the left sliding block, and the sliding plate. Of at least two flexible components, a first flexible component is between the small sliding block and the sliding plate. The sliding plate and the sliding block are placed between the right sliding block and the supporting bracket.

When an electrical plug is not inserted in to an electrical socket of an electrical receptacle, at least one locking block is mated with at least one tapered nub to form a self-locking mechanism such that the left sliding block, the right sliding block, the small sliding block, the sliding plate, and the supporting bracket are static relative to one another and are covering an electrical hot line output conductive plug bush and a neutral line output conductive plug bush under the supporting bracket.

When the electrical plug is inserted into the electrical socket, the at least one locking block separates from the at least one tapered nub to unlock the safety shutter device such that the left sliding block, the right sliding block, the small sliding block, and the sliding plate slide to expose the electrical hot line output conductive plug bush and the neutral line output conductive plug bush under the supporting bracket.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION

Figure 1:
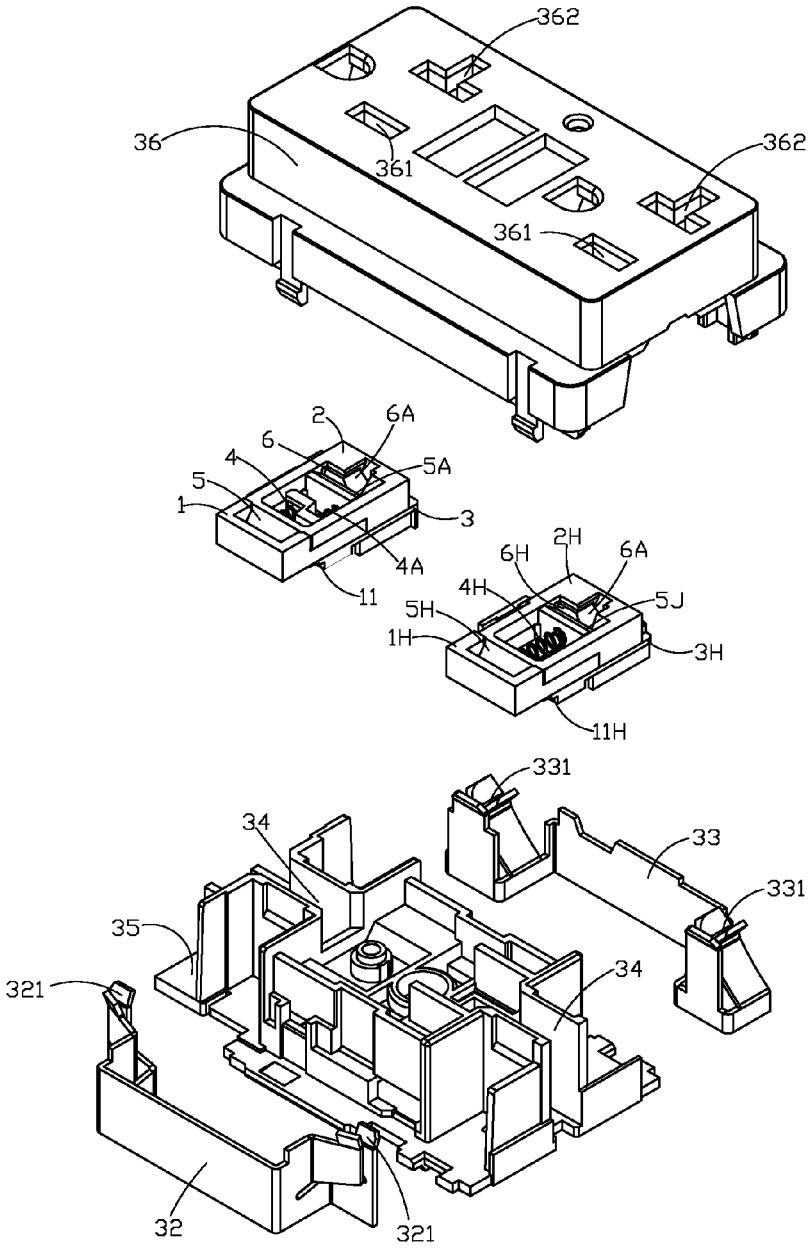
FIG. 1 is an example of a schematic breakdown of an electrical socket having safety shutters.

Reference will now be made in detail to the present exemplary, nonlimiting embodiments, examples of which are illustrated in the accompanying drawings. Wherever possible, the same reference numbers will be used throughout the drawings to refer to the same or like parts.

To facilitate the description, the parts in the T-shaped hole with the shape and direction identical with I-shaped hole are referred to as in the longitudinal direction, while the parts vertical with the I-shaped hole are referred to as in the horizontal direction. In addition, words indicating direction, such as "front", "back", "left," "right," and so, on are only used to describe the corresponding directions shown in the drawings and are not used for limitation.

Figure 2B:
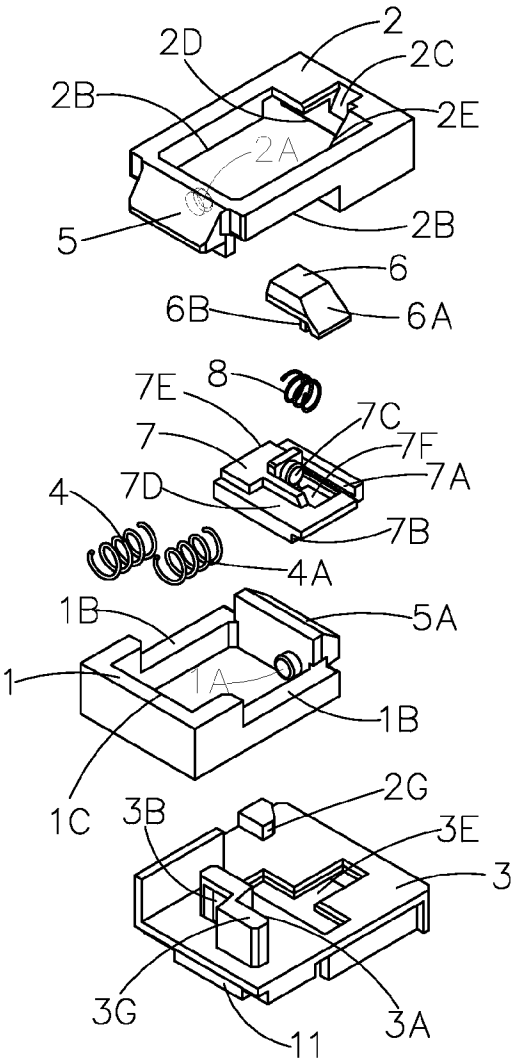
FIG. 2B is an exemplary schematic breakdown of the first example of a safety shutter.
Figure 2A:
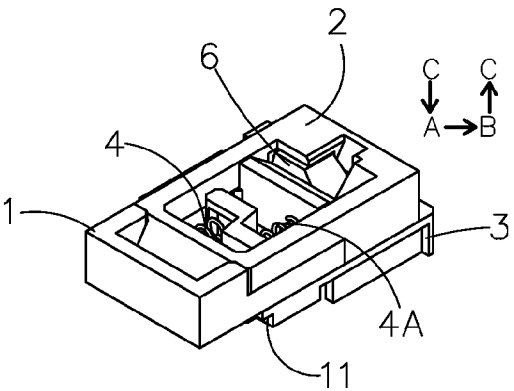
FIG. 2A is a first example of an assembled safety shutter.
Figure 3A:
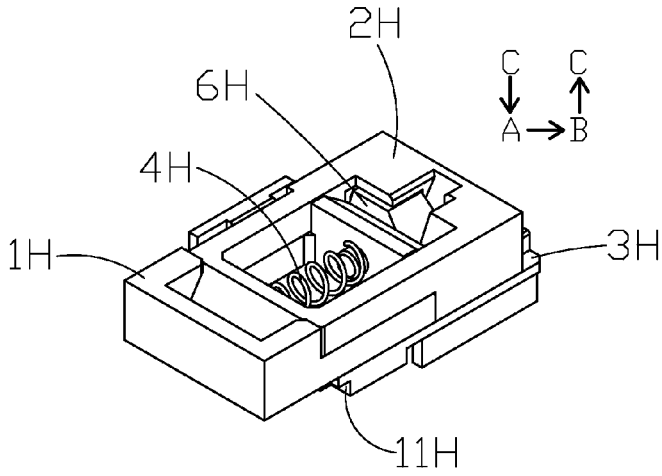
FIG. 3A is a second example of an assembled safety shutter.

To effectively prevent the occurrence of electrocution deaths and injuries caused by touching the conductive body in the electrical socket of an electrical receptacle shell surface 36, safety shutter devices are installed in electrical receptacles as shown in FIG. 2A and FIG. 3A. As shown in FIG. 1, the safety shutter devices for electrical receptacle sockets, and as shown in FIG. 2A and FIG. 3A, are installed among the I-shaped hot line output socket 361 and the T-shaped electrical neutral line output socket 362 of electrical receptacle shell surface 36. The electrical live line output conductive plug bush 321 and the electrical neutral line output conductive plug bush 331 in the receptacle are covered by the safety shutters.

When an electrical plug is not inserted into the electrical receptacle, the safety shutter devices for electrical receptacle sockets cover the electrical live line output conductive plug bush 321 and the electrical neutral line output conductive plug bush 331 beneath the sockets. The safety shutter devices are self-locking without moving, and the electrical sockets are under a closed protected state. It is impossible to touch the electrical hot line and neutral line output conductive plug bushes 321 and 331 through the electrical hot line output sockets 361 and neutral line output sockets 362 of the receptacle shell surface 36. Even if children or adults touch the electrical socket by mistake or touch the electrical socket with a small metal rod, they do not touch the conductive bodies under the sockets because the safety shutter devices do not move. Therefore, there will be no electrocution deaths and injuries. The receptacle with shutters is very safe.

When an electrical plug is inserted down into the electrical receptacle by force, with the insertion of the electrical plug, the safety shutter device is unlocked and moved. The shutters and the sloped small sliding block of the safety shutter device are moved, thus exposing the electrical hot line output conductive plug bush 321 and electrical neutral line output conductive plug bush 331 under the safety shutters of electrical socket. There is power supply output to the electrical plug when the electrical plug is inserted into the electrical receptacle.

When the electrical plug is unplugged out of the receptacle, at least one flexible component, such as a spring or a flexible metal blade, acts to return the shutter and the sloped block to the original and self-locked position. The electrical hot line output conductive plug bush and electrical neutral line output conductive plug bush are covered and the electrical sockets are under the closed protective state. It is impossible to see or touch the electrical hot line and zero line output conductive plug bush from the electrical hot line output socket and zero line output socket of the electrical receptacle shell surface. Even if children or adults touch the electrical socket by mistake or touch the electrical socket with a small metal rod, there are no electrocution deaths and injuries, so the receptacle is safe.

FIG. 2A and FIG. 2B are schematic drawings of example (1). As shown in FIG. 1, FIG. 2A and FIG. 2B, the safety shutter device is installed in an electrical receptacle and includes left sliding block 1, right sliding block 2, small sliding block 6, sliding plate 7, and supporting bracket 3. The left sliding block 1 and right sliding block 2 are cross-head, and combine to make a frame body that is combined or overlap integrated and placed above the supporting bracket 3 so that they may slide along the surface of supporting bracket 3.

Small sliding block 6 is placed on sliding plate 7. The combination of small sliding block 6 and sliding plate 7 is placed between the right sliding block 2 and supporting bracket 3. Sliding plate 7 also slides along the surface of supporting bracket 3. Small sliding block 6 slides along the surface of sliding plate 7.

The combination of left sliding block 1, right sliding block 2, small sliding block 6, and sliding plate 7 is placed on the multi-direction open supporting bracket 3. Two dislocated flexible components 4 and 4A are between the left sliding block 1, right sliding block 2, and supporting bracket 3. There is an additional flexible component 8 placed between small sliding block 6 and sliding plate 7.

When the electrical plug is not inserted into the electrical receptacle, left sliding block 1, right sliding block 2, small sliding block 6, sliding plate 7 and supporting bracket 3 are relatively static. In addition, sliding plate 7 and supporting frame 3 are locked and the entire safety shutter device is not moved, thereby covering the electrical hot line output conductive plug bush 321 and the electrical zero line output conductive plug bush 331 under supporting bracket 3. The electrical sockets on the electrical receptacle surface are under a closed protective state.

When an electrical plug is inserted into the electrical receptacle, left sliding block 1 and right sliding block 2 slide along the surface of supporting bracket 3, so sliding plate 7 and supporting bracket 3 are unlocked. During the motion, small sliding block 6 and sliding plate 7 first move towards the right direction (A->B) following left sliding block 2, and then upwards (B->C). The sliding motions expose the electrical hot line output conductive plug bush 321 and the electrical zero line output conductive plug bush 331 under supporting bracket 3. The electrical plug can fully insert into the electrical socket on the electrical receptacle surface.

As shown in FIG. 2A and FIG. 2B, supporting bracket 3 is open in multiple directions. There is T-shaped hole 3E corresponding the T-shaped electrical socket shape of the electrical receptacle surface on the multi-direction open supporting bracket 3 surface. There is another fixed block 3G or fixed groove on the supporting bracket 3 surface to fix flexible components, and there are troughs 3A and 3B on fixed block 3G. When the left sliding block 1 and right sliding block 2 are in a cross-head position, the frame body is overlap-placed on supporting bracket 3. Flexible component 4A is placed between left sliding block 1, supporting bracket 3, and fixed block 3G. Flexible component 4 is placed between right sliding block 2 and supporting bracket 3. The two flexible components 4A and 4 are dislocated side by side. When left and right sliding blocks 1 and 2 move towards the left and right ends of supporting bracket 3, respectively, flexible components 4A and 4 are compressed in reverse directions.

Left sliding block 1 is placed above the multi-direction open supporting bracket 3. As a mouth shape, the bottom is hollowed. When left sliding block 1 moves, it exposes a portion of the T-shaped hole above the multi-direction supporting bracket 3 and exposes the I-shaped electrical hot line output conductive plug bush 321 under the left sliding block 1.

There is one slope 5A placed at one end of left sliding block 1, above T-shaped hole 3E of multi-direction supporting bracket 3. Sloped block 5A, transverse shutter 7D on sliding plate 7, as well as the sloped block 6A on small sliding block 6 cover the T-shaped hole 3E beneath them on multi-direction open supporting bracket 3. When left sliding block 1, right sliding block 2, small sliding block 6, and sliding plate 7 move simultaneously, slope 5A, sloped block 6A, and transverse shutter 7D move to expose T-shaped hole 3E on multi-direction supporting bracket 3.

There is one transverse shutter 1C at the other end of left sliding block 1. The transverse shutter 1C and slope 5 on right sliding block 2 together cover the electrical hot line output conductive plug bush 321 under multi-direction open supporting bracket 3. When left sliding block 1 and right sliding block 2 move, transverse block 1C and slope 5 move to expose the electrical hot line output conductive plug bush 321 under multi-direction supporting bracket 3.

There is a fixed point 1A placed on an inner side wall at the end of left sliding block 1 to fix flexible component 4A. When left sliding block 1 is placed on multi-direction supporting bracket 3, flexible component 4A is placed between fixed point 1A and fixed block 3G of multi-direction supporting bracket 3. When an electrical plug is inserted into the electrical socket, left sliding block 1 moves towards the left and flexible component 4A is compressed to the left direction. When the electrical plug is unplugged out of the electrical socket, under the action of flexible component 4A, left sliding block 1 is returned to its original position.

In order to make left sliding block 1 and right sliding block 2 be cross-head, frame body overlap integrated, there are recesses 1B and 2B placed above the left sliding block 1 and below the lower beam of right slide block, respectively.

Right sliding block 2 and left sliding block 1 are in a cross-head position, and the frame bodies are overlapped on multi-direction open supporting bracket 3. Right sliding block 2 is a mouth shape, and the bottom is hollow. There is one slope 5 placed on right sliding block 2 and another slope 5A at the other end opposite to slope 5 on left sliding block 1. Block 5 and transverse shutter 1C of left sliding block 1 together cover the underlying electrical hot line output conductive plug bush. When left sliding block 1 and right sliding block 2 are moved to the left and right respectively, block 5 and transversal shutter 1C of left sliding block 1 move to expose the electrical hot line output conductive plug bush. As shown in FIG. 2A and FIG. 2B, the direction of the slope on slope 5 of right sliding block 2 is opposite to the slope on slope 5A on left sliding block 1. When an electrical plug blade touches slopes 5 and 5A, left sliding block 1 and right sliding block 2 move in opposite directions.

There is a fixed point 2A placed on an inner side wall at the end of left sliding block 2 to fix flexible component 4. When right sliding block 2 is placed on multi-direction supporting bracket 3, flexible component 4 is placed between fixed point 2A and fixed block 3G. When an electrical plug is inserted into the electrical socket, right sliding block 2 moves towards the right and flexible component 4 is compressed in the right direction. When the electrical plug is unplugged out of the electrical socket, under the action of flexible component 4, right sliding block 2 is returned to its original position.

There is one groove 2C on right sliding block 2 to facilitate the insertion of T-shaped plug. There are longitudinal trail 2D and transversal hook 2E cooperating with sliding plate 7 at the other end of right sliding block 2.

Sliding plate 7 is placed between the right end bottom of right sliding plate 2 and T-shaped hole 3E of supporting bracket 3. There is a longitudinal sliding way 7A on sliding plate 7, and the longitudinal sliding rail 2D on right sliding block cooperates with the longitudinal sliding way 7A on sliding plate 7, so that sliding plate 7 slides forwards and backwards in a longitudinal direction. There is one transversal recess 7B at the bottom of sliding plate 7. Transversal hook 2E of right sliding block 2 cooperates with transversal recesses 7B of sliding plate 7 so as to combine sliding plate 7 and right sliding block 2, and sliding plate 7 moves together with right sliding block 2.

There is one longitudinal long hole 7F on sliding plate 7, and one fixed point 7C at the end to fix flexible component 8.

Small sliding block 6 is located below right sliding block 2 and above sliding plate 7. There is one slope 6A at one end of small sliding block 6. When the combination of small sliding block 6 and sliding plate 7 is placed between right sliding block 2 and supporting bracket 3, the slope 6A, transversal shutter 7D of sliding plate 7, and slope 5A of left sliding block 1 cover T-shaped hole 3E.

There is a limit block 6B at the bottom of small sliding block 6, which is inserted into longitudinal long hole 7F of sliding plate 7. When small sliding block 6 moves on the surface of sliding plate 7, the limit block 6B prevents small sliding block 6 from sliding out from the surface of sliding plate 7.

There is one flexible component 8 placed between the end of small sliding block 6 and sliding plate 7. Even when people insert a metal rod into the T-shaped electrical socket on the electrical receptacle surface by force, the flexible component 8 is placed between small sliding block 6 and sliding plate 7. Therefore, even if the metal rod moves small sliding block 6, it could not move sliding plate 7 to expose the below T-shaped hole 3E below the supporting bracket 3. Thus the safety of electrical receptacle is significantly improved.

The utility model also has at least one locking block 7E and at least one matched tapered nub 2G. As shown in FIG. 2B, locking block 7E is placed on sliding plate 7. Corresponding matched tapered nub 2G is placed on multi-direction open supporting bracket 3. There is one recess at the back of sliding plate 7 (not shown in the figure). When the combination of left sliding block 1, right sliding block 2, small sliding block 6, and sliding plate 7 are placed on supporting bracket 3, the tapered nub 2G on supporting bracket 3 contacts with locking block 7E of sliding plate 7. That is, tapered nub 2G cooperates with locking block 7E so that sliding plate 7 is not moved, thus providing self-locking.

When an electrical plug is not inserted into the electrical socket, the locking block 7E cooperates with tapered nub 2G, so that the safety shutter device is self-locked. That is, left sliding block 1, right sliding block 2, small sliding block 6, sliding plate 7 and supporting bracket 3 are self-locked together. When the electrical plug is not inserted into the electrical socket, slope 5A on left sliding block 1, slope 5 on right sliding block 2, slope 6A on small sliding block 6, transversal shutter 1C on left sliding block 1, and transversal shutter 7D on sliding plate 7 cooperate to cover T-shaped hole 3E on supporting bracket 3 and to cover the electrical neutral line output conductive plug bush 331.

When an electrical plug is inserted down into the electrical receptacle by force, a T-shaped blade of the electrical plug contacts the slope 5A. An I-shaped blade of the electrical plug contacts slope 5. The T and I-shaped blades compress slopes 5A and 5, pushing left sliding block 1 to move left and right sliding block 2 to move right. When right sliding block 2 moves right, it will promote sliding plate 7 and small sliding block 6 to move right together (as the arrow shown in FIG. 2A), from original position (A) to second position (B). Thus, locking block 7E is separated from tapered nub 2G. Tapered nub 2G slides into the recess at the back of sliding plate 7, locking block 7E and tapered nub 2G are unlocked. That is, the safety shutter device is unlocked.

I-shaped blade and T-shaped blade of the electrical plug continue to press slopes 5, 5A, and 6A so that left and right sliding block 1 and 2 continue to move left and right, respectively. Small sliding block 6 moves forwards along the surface of sliding plate 7 (as the arrow shown in FIG. 2A). Small sliding block 6 moves from second position (B) to the third position (C), exposing T-shaped hole 3E on supporting bracket 3. The blades on the electrical plug pass through supporting bracket 3 into the electrical hot line and neutral line output conductive plug bushes under the supporting bracket 3. In this way, there is power supply output to the electrical plug.

When the electrical plug is inserted into the electrical receptacle, left sliding block 1, right sliding block 2, and small sliding block 6 are moved, and flexible components 4A, 4 and 8 are compressed. When the electrical plug is unplugged out of the electrical receptacle, and under the action of flexible components 4, 4A and 8, left sliding block 1, right sliding block 2, small sliding block 6, and sliding plate 7 are returned to their original static state. The locking block 7E on sliding plate 7 cooperates with tapered nub 2G again. Thus, the safety shutter device is self-locked again to cover the T-shaped hole 3E of supporting bracket 3.

During the process of safety shutter self-locking and unlocking, locking block 7E acts relative to tapered nub 2G, and tapered nub 2G is static.

As shown in FIG. 2A and FIG. 2B, the combination of left sliding block 1, right sliding block 2, small sliding block 6, and sliding plate 7 is placed on multi-direction open supporting bracket 3 as an integrated piece. The fixed block 3G on supporting bracket 3 is surrounded by left and right sliding blocks 1 and 2. Such a design also prevents left and right sliding blocks 1 and 2 from sliding off from the surface of multi-direction open supporting bracket 3 during their moving on the surface of multi-direction supporting bracket 3, while the left and right shutters are naturally fixed at the central position between the I-shaped socket and the T-shaped socket.

The left sliding block 1, right sliding block 2, small sliding block 6, sliding plate 7, and multi-direction open supporting bracket 3 are each composed of electrically insulating material.

Figure 3B:
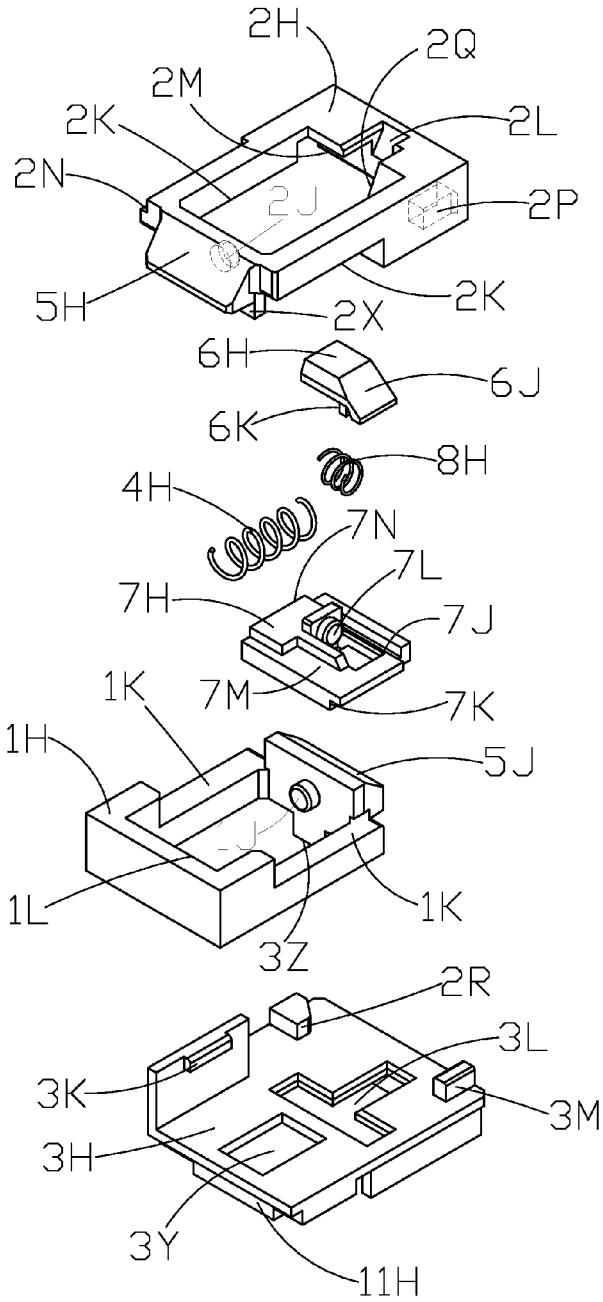
FIG. 3B is an exemplary schematic breakdown of the second example of a safety shutter.

FIG. 3A and FIG. 3B are the schematic drawings of example (2). As shown in FIG. 1, FIG. 3A and FIG. 3B, another structure for a safety shutter device for electrical receptacle sockets is composed of left sliding block 1H, right sliding block 2H, small sliding block 6H, sliding plate 7H, supporting bracket 3H, and flexible components 4H and 8H.

The left sliding block 1H and right sliding block 2H are cross-head. The frame body is combined or overlap integrated, and placed above the supporting bracket 3H to slide along the surface of supporting bracket 3H. Small sliding block 6H is placed on sliding plate 7H. The combination of small sliding block 6H and sliding plate 7H is placed between the right sliding block 2H and supporting bracket 3H. Sliding plate 7H slides along the surface of supporting bracket 3H, and small sliding block 6H slides along the surface of sliding plate 7H. The combination of left sliding block 1H, right sliding block 2H, small sliding block 6H and sliding plate 7H is placed on multi-direction open supporting bracket 3H. When the electrical plug is not inserted into the electrical receptacle, left sliding block 1H, right sliding block 2H, small sliding block 6H, sliding plate 7H, and supporting bracket 3H are relatively static. In addition, sliding plate 7H and supporting frame 3H are locked. The entire safety shutter device for the electrical receptacle socket is not moved, thereby covering the electrical hot line output conductive plug bush 321 and the electrical neutral line output conductive plug bush 331 under supporting bracket 3H. The electrical sockets on the electrical receptacle surface are under a closed protective state.

When the electrical plug is inserted into the electrical receptacle, left sliding block 1H and right sliding block 2H slide along the surface of supporting bracket 3H. Sliding plate 7H and supporting bracket 3H are unlocked. Thus, small sliding block 6H and sliding plate 7H first move towards the right direction following left sliding block 2H, exposing the electrical hot line output conductive plug bush 321 and the electrical neutral line output conductive plug bush 331 under supporting bracket 3H. The electrical plug can insert into the electrical socket on the electrical receptacle surface.

The difference between the safety shutter device shown in FIG. 3A and FIG. 3B and the safety shutter device shown in FIG. 2A and FIG. 2B is as follows: there is no fixed block 3G placed on supporting bracket 3H for fixing flexible components (refer to FIG. 2B). When left sliding block 1H and right sliding block 2H are positioned cross-head, and the frame body is overlapped on supporting bracket 3H, there is one flexible component 4H placed between left and right sliding blocks 1H and 2H.

There is one limit hole 3Y on supporting bracket 3H, and there is one limit block 3Z on left sliding block 1H. Limit block 3Z is inserted into limit hole 3Y. When left sliding block 1H moves on the surface of supporting bracket 3H, limit block 3Z cooperates with limit hole 3Y, preventing the left sliding block 1H from sliding off of the surface of supporting bracket 3H.

There is one guide block 3M on the surface of supporting bracket 3H, and one long groove on the bottom of right sliding block 2H. Guide block 3M is inserted into the long groove 2P. When right sliding block 2H moves on the surface of supporting bracket 3H, guide block 3M cooperates with long groove 2P to prevent the right sliding block 3H from sliding off of the surface of supporting bracket 3H.

The combined right sliding block 2H also cooperates with the projection 3K on the side wall of multi-direction supporting bracket 3H. Recess 2N on the side wall of right sliding block 2H combines with projection 3K on supporting bracket 3H.

Figure 5:
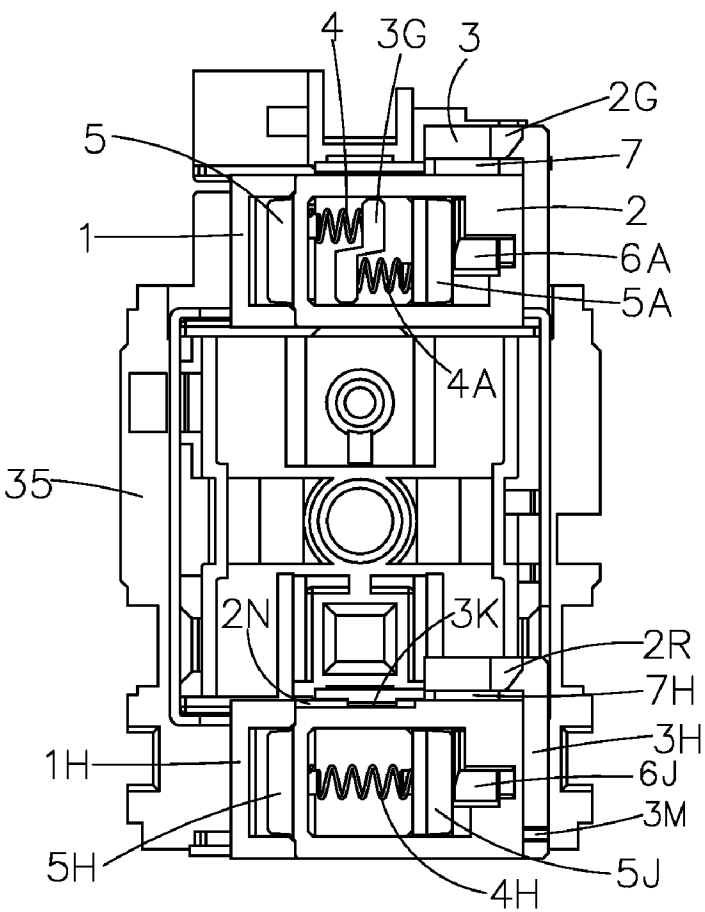
FIG. 5 is an example of a second view of an electrical receptacle with each of the first and second examples of a safety shutter installed and in a static locked state.
Figure 4:
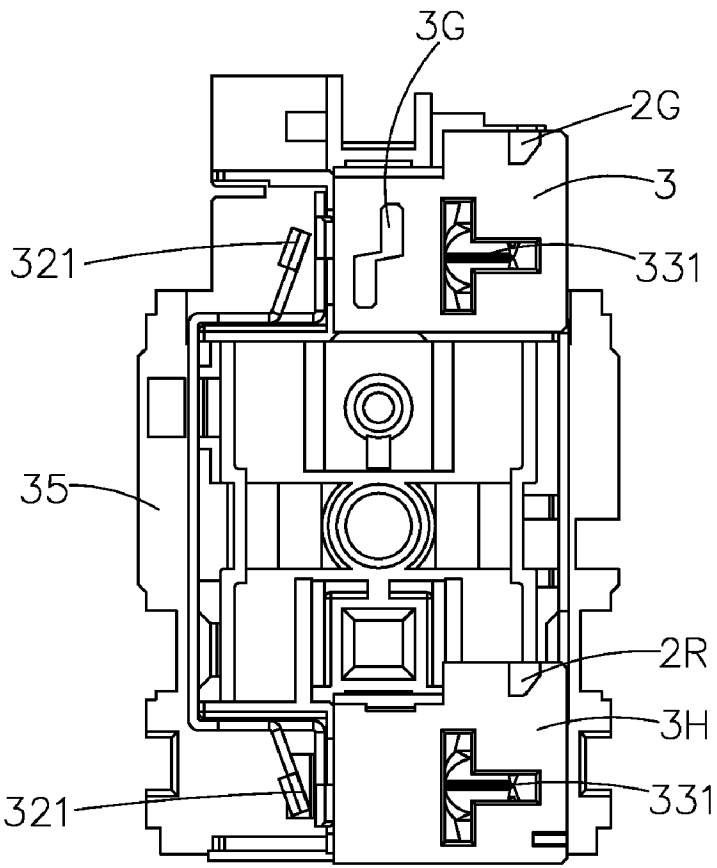
FIG. 4 is an example of a first view of an electrical receptacle with each of the first and second examples of a safety shutter installed.
Figure 6:
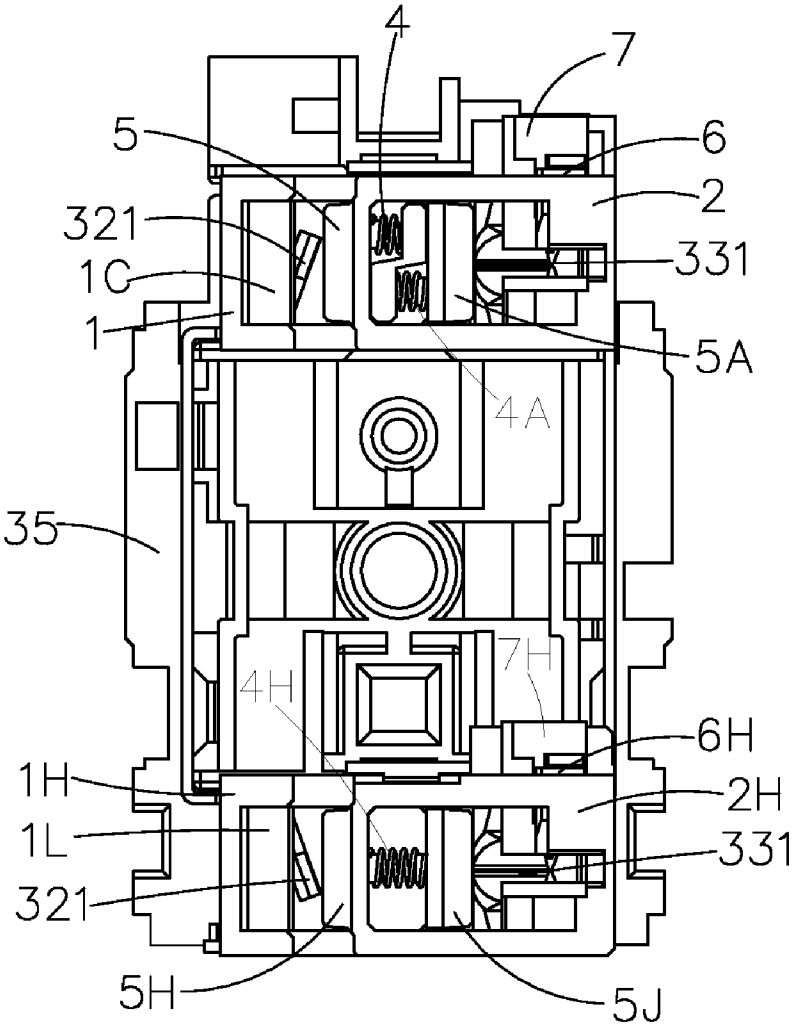
FIG. 6 is an example of a third view of an electrical receptacle with each of the first and second examples of a safety shutter installed and in an unlocked active state.

FIG. 4-FIG. 6 are internal structure schematic drawings of electrical receptacles installed with the safety shutters of examples 1 and 2.

As shown in FIG. 4 and FIG. 1, the safety shutter of example 1 is installed in the upper portion of the electrical receptacle, corresponding to the upper electrical socket. The safety shutter of example 2 is installed in the lower portion of the electrical receptacle, corresponding to the lower electrical socket.

During the assembly of the receptacle, first place multi-direction supporting bracket 3 and 3H above the electrical receptacle middle frame 35, so that the T-shaped hole on multi-direction supporting bracket 3 and 3H are right above the electrical neutral line output conductive plug bush in the electrical receptacle. Then insert the fixed column 11 and 11H of the multi-direction open supporting bracket 3 in position 34 of middle frame 35.

The respective combination of left and right sliding blocks 1, 1H, 2, 2H, small sliding block 6, 6H, sliding plate 7, 7H, and flexible component(s) 4, 4A, 4H, 8, 8H, is placed on the supporting bracket 3, 3H.

As shown in FIG. 5, when electrical plugs are unplugged out of the receptacle, the respective left sliding block, right sliding block, small sliding block, slopes on the sliding blocks, sliding plate and the transversal shutter cover the electrical hot line output conductive plug bush and the electrical neutral line output conductive plug bush below the supporting bracket. Therefore, all electrical sockets are under a closed protective state.

It is impossible to see or touch the electrical hot line and neutral line output conductive plug bushes from the electrical hot line output sockets or neutral line output sockets of the electrical receptacle surface. Even if children or adults touch the electrical socket by mistake or touch the electrical socket with a small metal rod, the safety shutter devices of the electrical receptacle sockets are not moved to enable touching of the conductor in the socket due to the self-locking features. There are no electrocution deaths and injuries, so the receptacle is safe.

As shown in FIG. 6, when electrical plugs are inserted into the electrical output sockets on the electrical receptacle surface by force, under the action of the electrical plug I-shaped blades and T-shaped blades, the safety shutters are unlocked. Respective left sliding block, right sliding block, sliding plate, and small sliding block slide along the surface of supporting bracket. During the sliding process, the electrical hot line and neutral line output conductive plug bushes are exposed. Thus, electrical hot line blades and electrical neutral line blades pass through the supporting bracket and insert into the below electrical hot line output conductive plug bush and electrical neutral line output conductive plug bush. The electrical plugs are fully inserted into the electrical receptacle, and there is power supply output.

When the electrical plugs are unplugged out from the electrical receptacle, under the action of the respective flexible components, the shutters/sliding blocks are returned to their original states. Even if children or adults touch the electrical sockets by mistake or touch the electrical sockets with small metal rods, the safety shutter device of the electrical receptacle socket is not moved to enable touching of the conductor in the socket due to the self-locking features. There are no electrocution deaths and injuries, so the receptacle sockets are safe.

The advantages of the safety shutter devices include safe and reliable protection to ensure the safety of users.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. A safety shutter device for an electrical receptacle comprising:

a left sliding block;

a right sliding block overlapping the left sliding block;

a small sliding block;

a sliding plate arranged to support the small sliding block such that the small sliding block slides longitudinally on the sliding plate;

a supporting bracket arranged to slidingly support the right sliding block, the left sliding block, and the sliding plate;

at least two flexible components, a first flexible component between the small sliding block and the sliding plate;

at least one locking block; and at least one tapered nub, wherein:

the sliding plate and the small sliding block are placed between the right sliding block and the supporting bracket, when an electrical plug is not inserted in to an electrical socket of an electrical receptacle, the at least one locking block is mated with the at least one tapered nub to form a self-locking mechanism such that the left sliding block, the right sliding block, the small sliding block, the sliding plate, and the supporting bracket are static relative to one another and cover an electrical hot line output conductive plug bush and a neutral line output conductive plug bush under the supporting bracket, and when the electrical plug is inserted into the electrical socket, the at least one locking block separates from the at least one tapered nub to unlock the safety shutter device such that the left sliding block, the right sliding block, the small sliding block, and the sliding plate slide to expose the electrical hot line output conductive plug bush and the neutral line output conductive plug bush under the supporting bracket.

2. The safety shutter device of claim 1, wherein:

when the electrical plug is inserted into the electrical receptacle, the right sliding block moves to the right and the left sliding block moves to the left relative to one another, the sliding plate and the small sliding block move right together with the right sliding block, from a first position to a second position, to unlock the at least one locking block from the at least one tapered nub, when the small sliding block and the sliding plate move longitudinally away from the second position to a third position, the first flexible component is compressed to enable a T-shaped electrical plug blade to enter the electrical receptacle, and when the electrical plug is removed from the electrical receptacle, the first flexible component returns from the compressed state, the left sliding block, the right sliding block, the small sliding block, and the sliding plate return from their relative movements, and the small sliding block and the sliding plate return to the first position from the third position.

3. The safety shutter device of claim 1, wherein:

the left sliding block further comprises a left block with a left slope;

the right sliding block further comprises a right block with a right slope;

the inclination of the left slope is opposite to the inclination of the right slope, when blades of the electrical plug compress the left slope and the right slope, the left sliding block and the right sliding block move in opposite directions while unlocking and separating the at least one locking block and the at least one tapered nub, and when the blades are removed, the left sliding block and the right sliding block return from the opposite directions and the at least one locking block and the at least one tapered nub cooperate to self-lock.

4. The safety shutter device of claim 1, wherein when the at least one locking block and the at least one tapered nub unlock and separate, one of the at least one locking block and the at least one tapered nub is mobile and the other is static.

5. The safety shutter device of claim 1 wherein:

the left sliding block and the right sliding block are in a cross-head position to form a frame body, and the frame body is overlapped as an integral piece or as an integrally crossed piece, and a second flexible component of the at least two flexible components is placed between the left sliding block and the right sliding block.

6. The safety shutter device of claim 1, wherein:

the left sliding block and the right sliding block are in a cross-head position to form a frame body, and the frame body is overlapped as an integral piece or as an integrally crossed piece, the supporting bracket further comprises a fixed block in a middle position for fixing flexible components of the at least two flexible components, when the left sliding block and the right sliding block are placed on the supporting bracket, the left sliding block and the right sliding block surround the fixed block, two flexible components of the at least two flexible components are parallel and dislocated from one another and one of the two flexible components is placed between the left sliding block and the fixed block and another of the two flexible components is placed between the right sliding block and the fixed block, and when the left sliding block and the right sliding block move in opposite directions, the two flexible components are compressed in opposite directions.

7. The safety shutter device of claim 1, wherein:

the left sliding block and the right sliding block are in a cross-head position to form a frame body, and the frame body is overlapped as an integral piece or as an integrally crossed piece, the supporting bracket further comprises a fixed groove in a middle position for fixing a second flexible component of the at least two flexible components, when the left sliding block and the right sliding block are placed on the supporting bracket, the left sliding block and the right sliding block surround the fixed groove, the second flexible component is placed between the left sliding block and the right sliding block, and when the left sliding block and the right sliding block move in opposite directions, the second flexible component is compressed.

8. The safety shutter device of claim 1, wherein the left sliding plate, the right sliding plate, the small sliding block, the sliding plate and the supporting bracket are each composed of an insulating material.

9. The safety shutter device of claim 1, wherein:

the supporting bracket enables multi-directional sliding, and the at least one locking block is located on the sliding plate and the at least one tapered nub is placed on the supporting bracket.

10. The safety shutter device of claim 9, wherein the sliding plate cooperates with the right sliding block to move together in a rightward direction relative to the left sliding block.

11. The safety shutter device of claim 10, wherein:

the sliding plate further comprises a bottom surface, a transversal recess on the bottom surface, and a longitudinal sliding groove, the right sliding block further comprises a longitudinal sliding rail and a transversal hook, the longitudinal sliding rail cooperates with the longitudinal sliding groove so that the sliding plate is configured to slide from a first position to a second position, and the transversal hook cooperates with the transversal recess so that the sliding plate is configured to move transversally left and right together with the right sliding block.

12. The safety shutter device of claim 11, wherein:

the left sliding block further comprises a left block with a left slope;

the right sliding block further comprises a right block with a right slope;

an inclination of the left slope is opposite to the inclination of the right slope, when blades of the electrical plug compress the left slope and the right slope, the left sliding block and the right sliding block move in opposite directions while unlocking and separating the at least one locking block and the at least one tapered nub, and when the blades are removed, the left sliding block and the right sliding block return from the opposite directions and the at least one locking block and the at least one tapered nub cooperate to self-lock.

13. The safety shutter device of claim 12, wherein when the at least one locking block and the at least one tapered nub unlock and separate or self-lock, one of the at least one locking block and the at least one tapered nub is mobile and the other is static.

14. The safety shutter device of claim 13 wherein:

the left sliding block and the right sliding block are in a cross-head position to form a frame body, and the frame body is overlapped as an integral piece or as an integrally crossed piece, and a second flexible component of the at least two flexible components is placed between the left sliding block and the right sliding block.

15. The safety shutter device of claim 13, wherein:

the left sliding block and the right sliding block are in a cross-head position to form a frame body, and the frame body is overlapped as an integral piece or as an integrally crossed piece, the supporting bracket further comprises a fixed block in a middle position for fixing flexible components of the at least two flexible components, when the left sliding block and the right sliding block are placed on the supporting bracket, the left sliding block and the right sliding block surround the fixed block, two flexible components of the at least two flexible components are parallel and dislocated from one another and one of the two flexible components is placed between the left sliding block and the fixed block and another of the two flexible components is placed between the right sliding block and the fixed block, and when the left sliding block and the right sliding block move in opposite directions, the two flexible components are compressed in opposite directions.

16. The safety shutter device of claim 15, wherein:

when the electrical plug is inserted into the electrical receptacle, the right sliding block moves to the right and the left sliding block moves to the left relative to one another, the sliding plate and the small sliding block move right together with the right sliding block, from the first position to the second position, to unlock the at least one locking block from the at least one tapered nub, when the small sliding block and the sliding plate move longitudinally away from the second position to a third position, the first flexible component is compressed to enable a T-shaped electrical plug blade to enter the electrical receptacle, and when the electrical plug is removed from the electrical receptacle, the first flexible component returns from the compressed state, the left sliding block, the right sliding block, the small sliding block, and the sliding plate return from their relative movements, and the small sliding block and the sliding plate return to the first position from the third position.

17. The safety shutter device of claim 13, wherein:

the left sliding block and the right sliding block are in a cross-head position to form a frame body, and the frame body is overlapped as an integral piece or as an integrally crossed piece, the supporting bracket further comprises a fixed groove in a middle position for fixing a second flexible component of the at least two flexible components, when the left sliding block and the right sliding block are placed on the supporting bracket, the left sliding block and the right sliding block surround the fixed groove, the second flexible component is placed between the left sliding block and the right sliding block, and when the left sliding block and the right sliding block move in opposite directions, the second flexible component is compressed.

18. The safety shutter device of claim 17, wherein:

when the electrical plug is inserted into the electrical receptacle, the right sliding block moves to the right and the left sliding block moves to the left relative to one another, the sliding plate and the small sliding block move right together with the right sliding block, from the first position to the second position, to unlock the at least one locking block from the at least one tapered nub, when the small sliding block and the sliding plate move longitudinally away from the second position to a third position, the first flexible component is compressed to enable a T-shaped electrical plug blade to enter the electrical receptacle, and when the electrical plug is removed from the electrical receptacle, the first flexible component returns from the compressed state, the left sliding block, the right sliding block, the small sliding block, and the sliding plate return from their relative movements, and the small sliding block and the sliding plate return to the first position from the third position.

19. The safety shutter device of claim 14, wherein:

when the electrical plug is inserted into the electrical receptacle, the right sliding block moves to the right and the left sliding block moves to the left relative to one another, the sliding plate and the small sliding block move right together with the right sliding block, from the first position to the second position, to unlock the at least one locking block from the at least one tapered nub, when the small sliding block and the sliding plate move longitudinally away from the second position to a third position, the first flexible component is compressed to enable a T-shaped electrical plug blade to enter the electrical receptacle, and when the electrical plug is removed from the electrical receptacle, the first flexible component returns from the compressed state, the left sliding block, the right sliding block, the small sliding block, and the sliding plate return from their relative movements, and the small sliding block and the sliding plate return to the first position from the third position.

20. The safety shutter device of claim 19, wherein the left sliding plate, the right sliding plate, the small sliding block, the sliding plate and the supporting bracket are each composed of an insulating material.

* * * * *